US011279503B2

(12) United States Patent
Benin

(10) Patent No.: US 11,279,503 B2
(45) Date of Patent: Mar. 22, 2022

(54) PLANT FOR AUTOMATED PACKAGING OF ITEMS IN CARDBOARD BOXES

(71) Applicant: Panotec S.r.l., Cimadolmo (IT)

(72) Inventor: Marco Benin, San Bonifacio (IT)

( * ) Notice: Subject to any disclaimer, the term of this patent is extended or adjusted under 35 U.S.C. 154(b) by 0 days.

(21) Appl. No.: 16/633,157

(22) PCT Filed: Jul. 31, 2018

(86) PCT No.: PCT/IB2018/055706
§ 371 (c)(1),
(2) Date: Jan. 23, 2020

(87) PCT Pub. No.: WO2019/025955
PCT Pub. Date: Feb. 7, 2019

(65) Prior Publication Data

US 2020/0198815 A1 Jun. 25, 2020

(30) Foreign Application Priority Data

Aug. 3, 2017 (IT) ..... 102017000090029

(51) Int. Cl.
*B65B 5/02* (2006.01)
*B65B 11/00* (2006.01)
(Continued)

(52) U.S. Cl.
CPC ..... *B65B 5/024* (2013.01); *B65B 11/004* (2013.01); *B65B 35/24* (2013.01); *B65B 43/126* (2013.01); *B65B 43/305* (2013.01); *B65B 49/10* (2013.01)

(58) Field of Classification Search
CPC ..... B31B 50/624; B31B 50/252; B31B 50/52; B31B 2105/0024; B31B 2120/102;
(Continued)

(56) References Cited

U.S. PATENT DOCUMENTS 1,887,864 A * 11/1932 Stokes ..... B65B 5/024 206/45.3
3,908,333 A * 9/1975 Cavanna ..... B65B 43/52 53/51

(Continued)

FOREIGN PATENT DOCUMENTS

EP 2890554 7/2015
WO 2014117817 8/2014

*Primary Examiner* — Thomas M Wittenschlaeger
(74) *Attorney, Agent, or Firm* — Themis Law

(57) ABSTRACT

A plant for automated packaging of items in cardboard boxes includes a forming station of open sheet boxes starting from a cardboard web, an item introduction system, a box closing station, and a feeding system. A cutting and creasing system at the forming station produces a longitudinal elongate element defining the bottom and top walls and a first pair of side walls of the box, and transverse panels providing the second pair of side walls. A first gluing system bonds the transverse panels to the elongate element by applying hot-melt strips on the side edges of the elongate element, and a pair of suction-cup manipulators applies the transverse panels on the elongate element at the glue strips to obtain a cross-shaped blank. The closing station includes a folding and automatic gluing system that folds and bonds the side walls and the top wall of the box to produce finished packages.

11 Claims, 7 Drawing Sheets

(51) Int. Cl.

| | |
|---|---|
| ***B65B 35/24*** | (2006.01) |
| ***B65B 43/12*** | (2006.01) |
| ***B65B 43/30*** | (2006.01) |
| ***B65B 49/10*** | (2006.01) |

(58) Field of Classification Search
CPC ... B31B 2110/35; B65B 11/004; B65B 49/10; B65B 49/14; B65B 35/24; B65B 35/44; B65B 43/305; B65B 43/126; B65B 5/024
See application file for complete search history.

(56) References Cited

U.S. PATENT DOCUMENTS

| | | | | |
|---|---|---|---|---|
| 4,463,541 | A * | 8/1984 | Nowacki | B65B 11/004 53/207 |
| 4,727,708 | A * | 3/1988 | Conforto | B65B 5/024 53/534 |
| 5,148,654 | A * | 9/1992 | Kisters | B65B 5/024 53/462 |
| 6,170,231 | B1 * | 1/2001 | Detterman | B65B 5/024 53/207 |
| 6,357,212 | B1 * | 3/2002 | Salm | B65B 51/023 53/558 |
| 6,904,733 | B2 * | 6/2005 | Boix Jaen | B65B 5/024 53/209 |
| 9,962,895 | B2 * | 5/2018 | Ponti | B65B 59/001 |
| 10,286,621 | B2 * | 5/2019 | Toro | B31B 50/62 |
| 10,543,945 | B2 * | 1/2020 | Sytema | B65B 5/024 |
| 10,836,517 | B2 * | 11/2020 | Ponti | B31B 50/00 |
| 2008/0020916 | A1 * | 1/2008 | Magnell | G01B 11/043 493/65 |
| 2010/0011924 | A1 * | 1/2010 | Bernreuter | B26D 5/02 83/39 |

* cited by examiner

PLANT FOR AUTOMATED PACKAGING OF ITEMS IN CARDBOARD BOXES

FIELD OF THE INVENTION

The present invention generally finds application in the field of plants for making packages and particularly relates to a plant for automated packaging of items in cardboard boxes.

BACKGROUND ART

Machines have been long known for making and forming boxes from continuously fed deployed cardboard webs or sheets.

These machines comprise means for feeding the cardboard sheets and means for cutting, creasing and folding the sheets respective longitudinal and transverse directions to form the folded and closed box.

A first drawback of these machines is that they do not comprise means for introducing and positioning of the items to be packaged in the boxes.

Therefore, the boxes are filled either by another machine separate from that for forming the boxes or manually by an operator, which involves a considerable increase of the overall processing times.

Furthermore, if filling is carried out by means of a further machine, this drawback causes an increase of the overall dimensions and the construction complexity of the entire plant.

In an attempt to at least partially obviate this drawback, plants have been developed that include both stations for forming the boxes and stations for introducing objects therein.

US20150367974 discloses a plant for forming folded boxes from a continuous-feed cardboard web and for automated packaging of items therein.

Namely, the plant comprises a cutting and creasing station for cutting and creasing the cardboard web that is being continuously fed from an upstream roll, a folding station for folding the cardboard sheets that have been cut and creased to form the folded box and means for feeding the processed sheets.

In addition, the plant comprises means for feeding and positioning the items to be packaged, which are synchronized with the above described feeding means.

The positioning means are configured to locate objects on the deployed cardboard sheet being fed and processed before reaching the folding station in which the folded box is made.

Nevertheless, a first drawback of this arrangement is that the boxes made by this system do not have a stable structure and are prone to bending and deformation with time, particularly when they are being ordinarily displaced and transported.

Furthermore, the bottom wall and the side walls of the boxes are not reinforced and tend to collapse, particularly in case of heavy-weight items and packages.

A further drawback of this arrangement is that the steps for processing the continuous-feed cardboard web to obtain the deployed sheets to be later folded involves considerable waste of material, that cannot be reused to make further boxes.

In addition, the system does not have conveyor means associated with the cutting and folding stations for automatically removing the processing waste.

Technical Problem

In the light of the prior art, the technical problem addressed by the present invention is to provide a plant for automated packaging of items in cardboard boxes in which the boxes have a highly stable and resistant structure and their fabrication produces limited waste.

Disclosure of the Invention

The object of the present invention is to obviate the above discussed drawback, by providing a plant for automated packaging of items in cardboard boxes, that is highly efficient and relatively cost-effective.

A particular object of the present invention is to provide a plant as described hereinbefore that affords automatic and synchronized box formation and item packaging.

A further object of the present invention is to provide a plant as described hereinbefore that can provide boxes having a highly stable and resistant structure.

Another object of the present invention is to provide a plant as described hereinbefore that can provide boxes with reinforced bottom and side walls.

A further object of the present invention is to provide a plant as discussed hereinbefore that can limit processing waste in the box making process.

Yet another object of the present invention is to provide a plant as described hereinbefore that has a small size and can be simply assembled.

These and other objects, as more clearly explained hereinafter, are fulfilled by a plant for automated packaging of items in cardboard boxes as defined in claimed in claim 1, comprising a forming station for forming open sheet boxes from a continuous-feed web, and placing them on a horizontal surface, means for introducing items into the open boxes, a closing station for closing the open boxes with the items therein and feeding means for feeding the open boxes from the forming station to the closing station.

The first gluing means comprise a first applicator for applying hotmelt glue strips on the side edges of the elongate element and the forming station comprises a pair of suction cup-manipulators for picking up the transverse panels and applying them on the elongate element at the glue strips to obtain the cross-shaped blank.

The forming station comprises cutting and creasing means for cutting and creasing the continuous-feed web, which are adapted to provide a longitudinal panel defining the bottom wall, the top closing wall, the first pair of side walls of the box, and a pair of transverse panels adapted to form the second pair of side walls of the box, as well as first gluing means for gluing the transverse panels to the longitudinal panel, such that a substantially cross-shaped one-piece deployed blank is provided.

Also, the closing station comprises folding and automatic gluing means for folding side walls of the box and the top closing wall, such that finished packages are formed, that are ready for storage or shipment.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a plant for automated packaging of items in cardboard boxes which is described as a non-limiting example with the help of the annexed drawings, in which.

DETAILED DESCRIPTION OF A PREFERRED EXEMPLARY EMBODIMENT

Particularly referring to the figures, a plant is shown, which is generally designated by numeral 1, for automated packaging of one or more items O in the boxes B.

The items O may be selected from different classes, without departure from the scope of the present invention, whereas the boxes B may be of the type as disclosed in the Italian patent application 102016000131802, by the proprietor of the present application.

Figure 14:
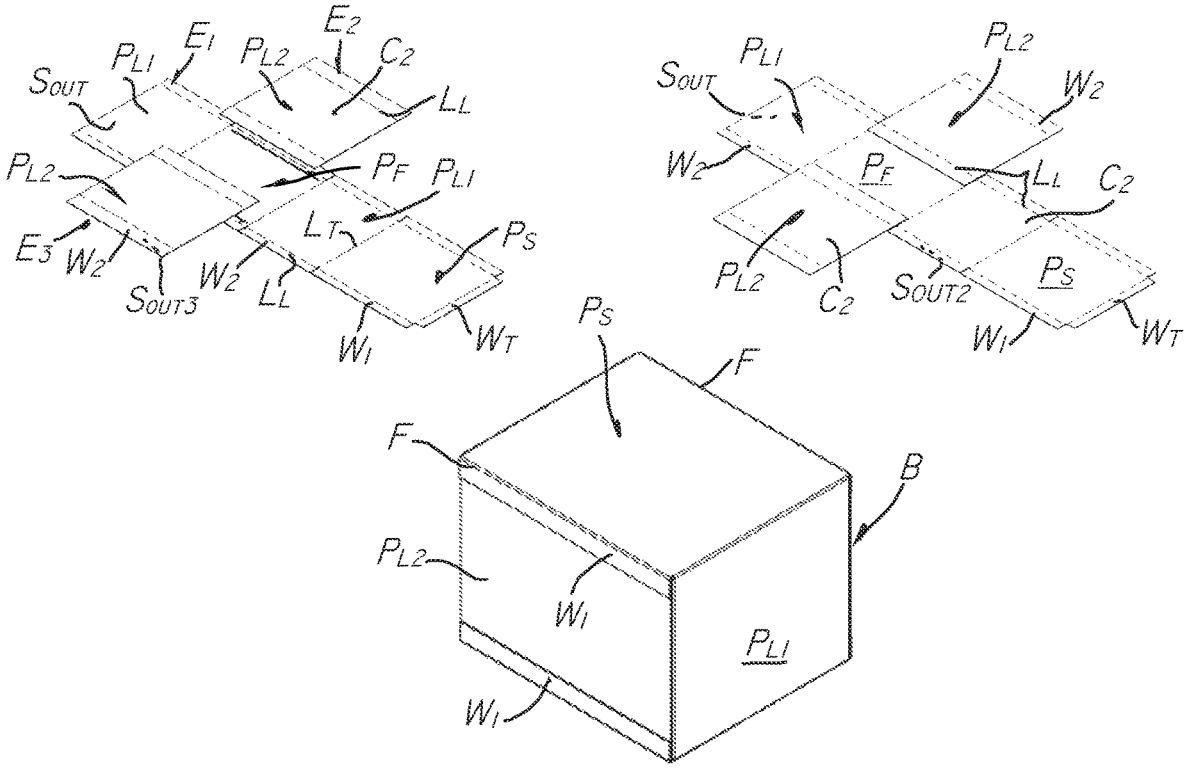
FIG. 14 are perspective views of a cardboard box formed by means of the system of the invention.

Particularly, as best shown in FIG. 14, each box B comprises, in its assembled configuration, a bottom wall that $P_F$, a top closing wall $P_S$, a first pair of side walls $P_{L1}$ and a second pair of side walls $P_{L2}$ perpendicular to the first to define a compartment for containing the items O.

By way of example, the boxes B may have a first main format having a length of 600 mm, a width of 500 mm and a height of 450 mm, or a second main format having a length of 200 mm, a width of 150 mm and a height of 50 mm.

In a preferred embodiment of the invention, the plant 1 comprises a forming station 2 for forming deployed sheet boxes from a cardboard web M, as shown in FIGS. 3 to 8 and introduction means 3 for introducing items O into the boxes B.

The plant 1 comprises a closing station 4 for closing the boxes B with the items O therein, as shown in FIGS. 9 to 13 and feeding means 5 for feeding the open boxes from the forming station 2 to the closing station 4.

The forming station 2 and the closing station 4 for forming and closing the boxes B may comprise respective lattice frames 6 which are adapted to also support the introduction means 3 and the feeding means 5.

Furthermore, supply means 7 may be provided for supplying the continuous-feed cardboard web M from a stocking station, not shown, into the station 2 for forming in a longitudinal direction X.

For example, the supply means 7 may be of well-known type and may comprise one or more rollers 8 rotating about respective transverse axes and placed immediately upstream from the feeding means 5.

The feeding means 5 may comprise a first belt conveyor 9 which is substantially inclined to the horizontal and positioned in the forming station 2 to receive the cardboard web M from the supply means 7.

The feeding means 5 may also comprise a belt system 10 placed in the closing station 4 immediately downstream from the first belt conveyor 9 of the forming station 2.

Figure 1:
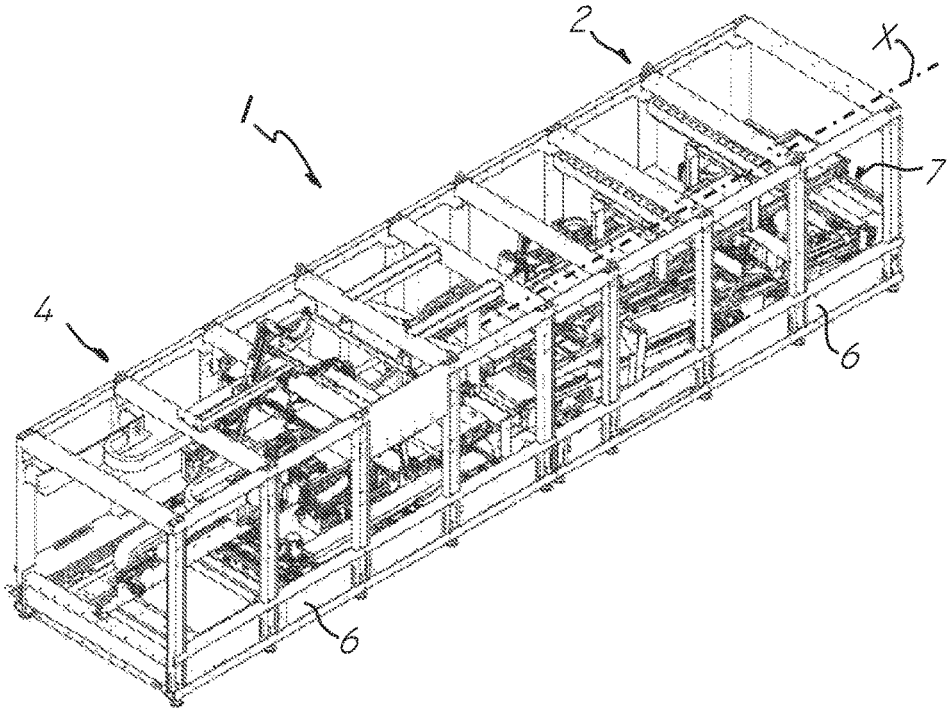
FIGS. 1 and 2 are perspective and broken-away side views of the plant of the invention.
Figure 2:
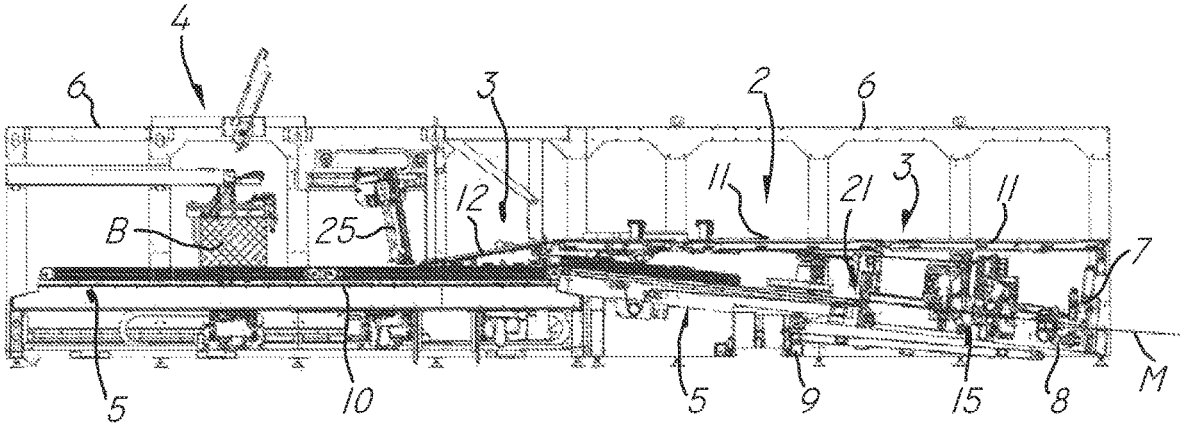
Figure 3:
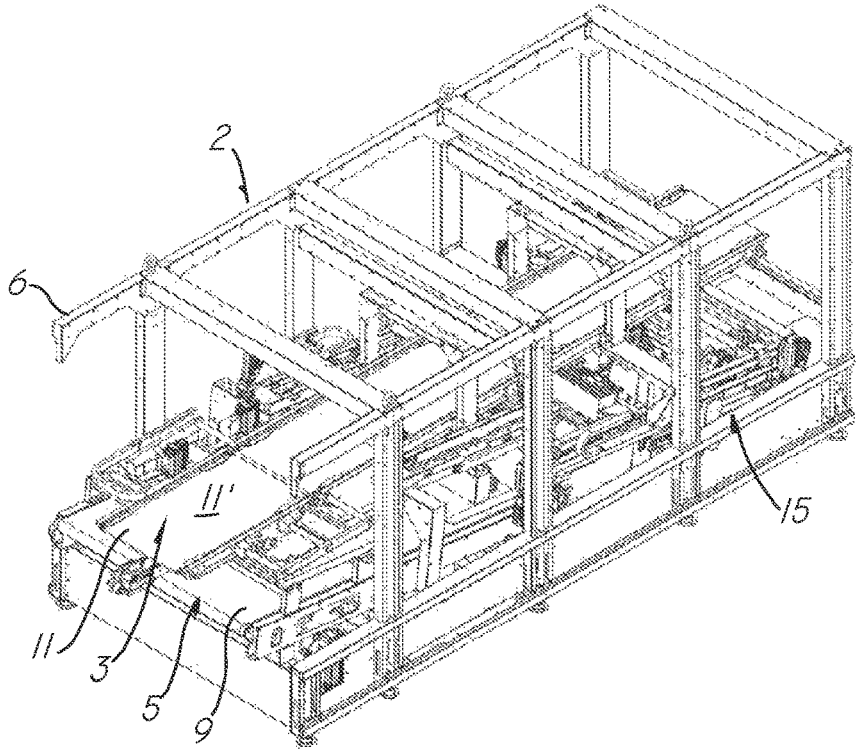
FIGS. 3 and 4 are top view and broken-away side views of a first station of the plant of FIG. 1.
Figure 4:
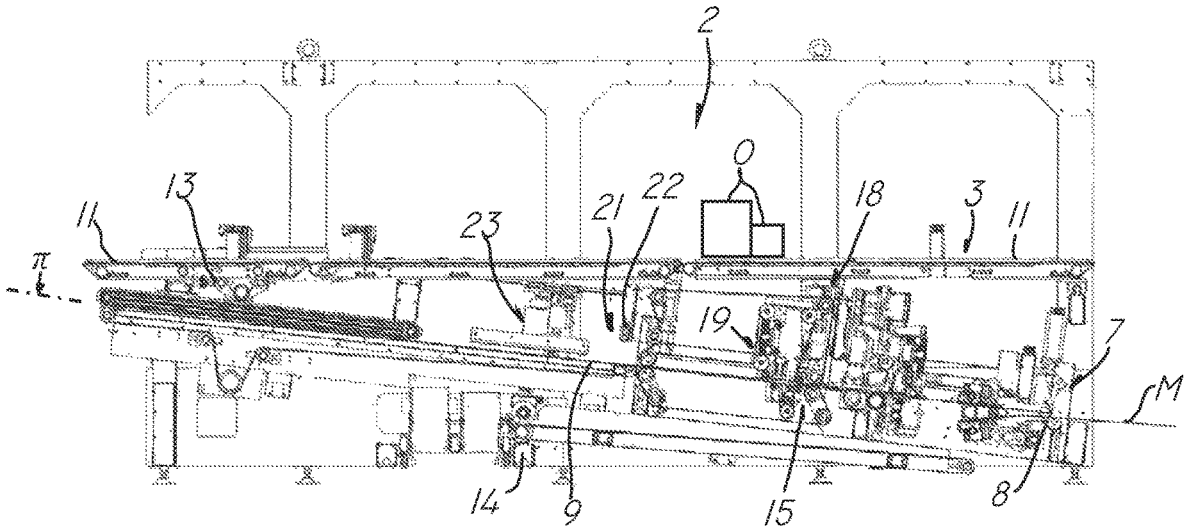
Figure 5:
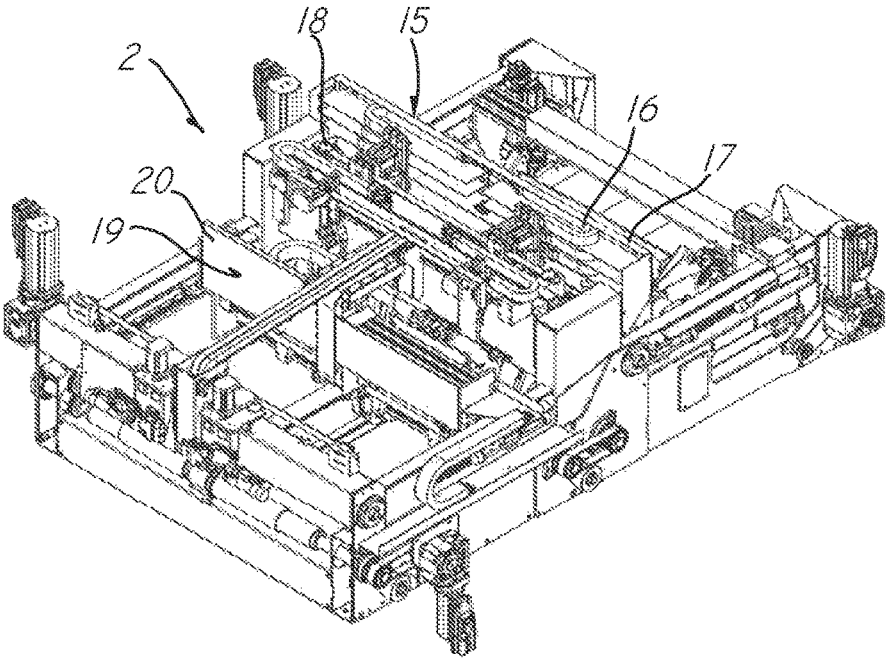
FIGS. 5 and 6 are perspective and a broken-away side view of a first detail of the first station of FIGS. 3 and 4.
Figure 6:
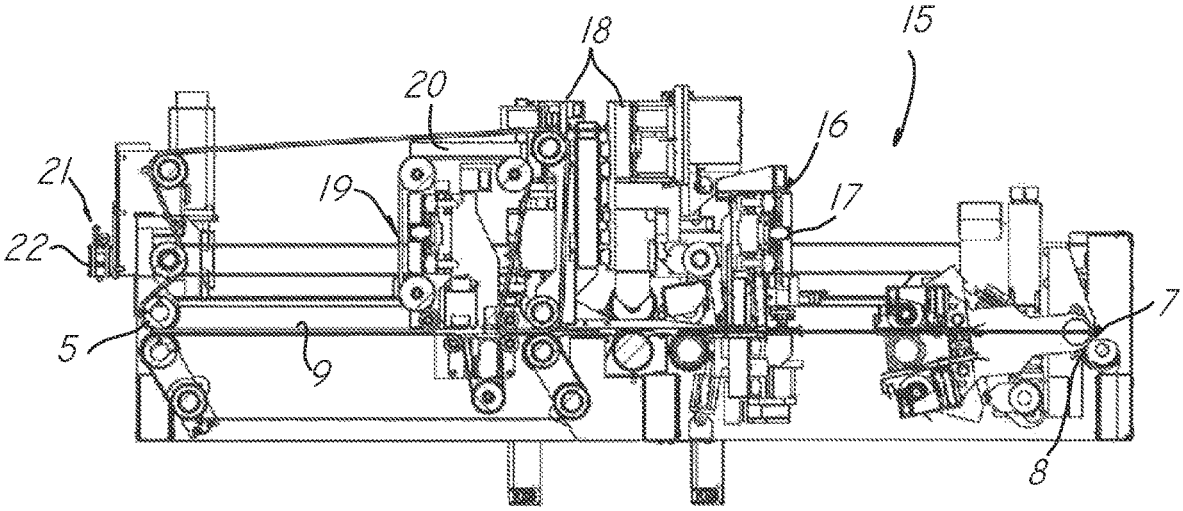

As best shown in FIGS. 2 and 4, the introduction means 3 for introducing the items O may comprise a number of second belt conveyors 11, which are also placed in the forming station 2 above the inclined plane $\pi$ of the first belt conveyor 9 and a belt with a knife edge conveyor 12 in the closing station 4 to place the items O on the deployed cardboard sheet before the latter is folded.

Advantageously, the introduction means 3 for introducing the items O and the feeding means 5 for feeding the open boxes B may be connected to a control unit by software which is adapted to synchronize the movements and check proper matching between the batches of items O and the open boxes B being fed.

The belt 11' of the second series located immediately upstream from the knife edge conveyor 12 of the closing station 4 may be slidably mounted to guide means 13 transverse to the longitudinal feeding direction X for feeding the item O or centering its position with respect to the open box B that is being fed along the first belt conveyor 9.

Preferably, a belt conveyor 14 may be provided for conveying trimmings generated in the forming station 2 below the first belt conveyor 9 them toward a shredding unit.

In a peculiar aspect of the invention, the forming station 2 comprises cutting and creasing means 15 for cutting and creasing the continuous-feed cardboard web M, which are adapted to provide an elongate longitudinal element $E_1$ defining the bottom wall $P_F$, the top wall $P_S$ and the first pair of side walls $P_{L1}$ of the box B and a pair of transverse panels $E_2$, $E_3$ adapted to form the second pair of side walls $P_{L2}$ of the box B.

The cutting and creasing means 15 may comprise a first series of transverse tools 16 mounted to a first carriage 17, moving transverse to the direction of introduction X of the continuous-feed web M and a first series of longitudinal tools 18 adapted to form a plurality of longitudinal cutting and creasing lines $L_L$ on the deployed cardboard sheet.

Particularly, the first transverse tools 16 cut the continuous-feed web M to create the elongate element $E_1$ and the transverse panels $E_2$, $E_3$ whereas the longitudinal tools 18 form creasing lines $L_L$ along their longitudinal edges, defining respective longitudinal side flaps $W_1$, $W_2$ and a corresponding central body $C_1$, $C_2$.

In addition, the cutting and creasing means 15 comprise a second series of transverse tools 19 mounted to a second carriage 20, moving transverse to the direction of feed X of the deployed sheet and adapted to form a plurality of transverse creasing lines $L_T$ thereon.

The transverse creasing lines $L_T$ are adapted to define the first pair of side walls $P_{L1}$, the top wall $P_S$ and the bottom wall $P_F$ along the longitudinal extent of the elongate element $E_1$.

Namely, the first side walls $P_{L1}$ are in a position that is longitudinally offset from and alternate to the top wall $P_S$ and the bottom wall $P_F$ and are joined to the latter along the transverse creasing lines $L_T$.

The walls $P_S$, $P_F$, $P_{L1}$ of the elongate element $E_1$ and the transverse panels $E_2$, $E_3$ may have the same overall width I whereas the side flaps $W_2$ of the transverse panels $E_2$, $E_3$ may have a width $I_1$ greater than the width $I_2$ of the side flaps $W_1$ of the walls $P_S$, $P_F$, $P_{L1}$ of the elongate element $E_1$.

Furthermore, the second transverse tools 19 are adapted to create a transverse folding flap $W_T$, at the transverse end F of the top wall $P_S$, which is designed to be glued to the outer surface $S_{OUT}$ of one of the first side walls $P_{L1}$ as the box B is being closed.

In a further peculiar aspect of the invention, the forming station 2 further comprises first gluing means 21 for gluing the transverse panels $E_2$, $E_3$ to the longitudinal element $E_1$ to provide a substantially cross-shaped one-piece deployed blank H.

Figure 7:
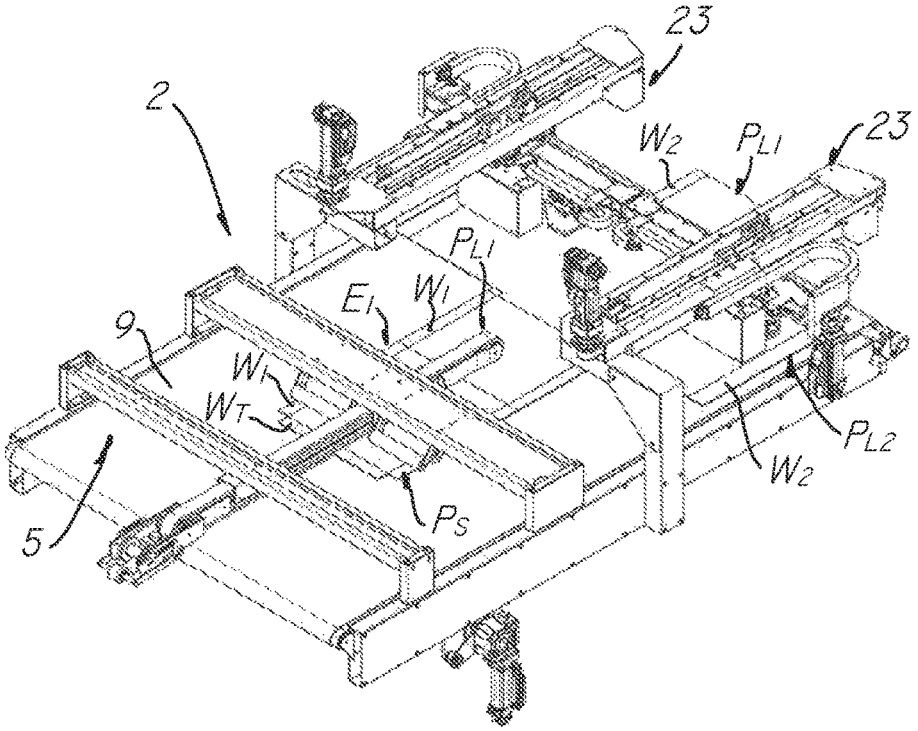
FIGS. 7 and 8 are perspective and a top views of a second detail of the first station of FIGS. 3 and 4.
Figure 8:
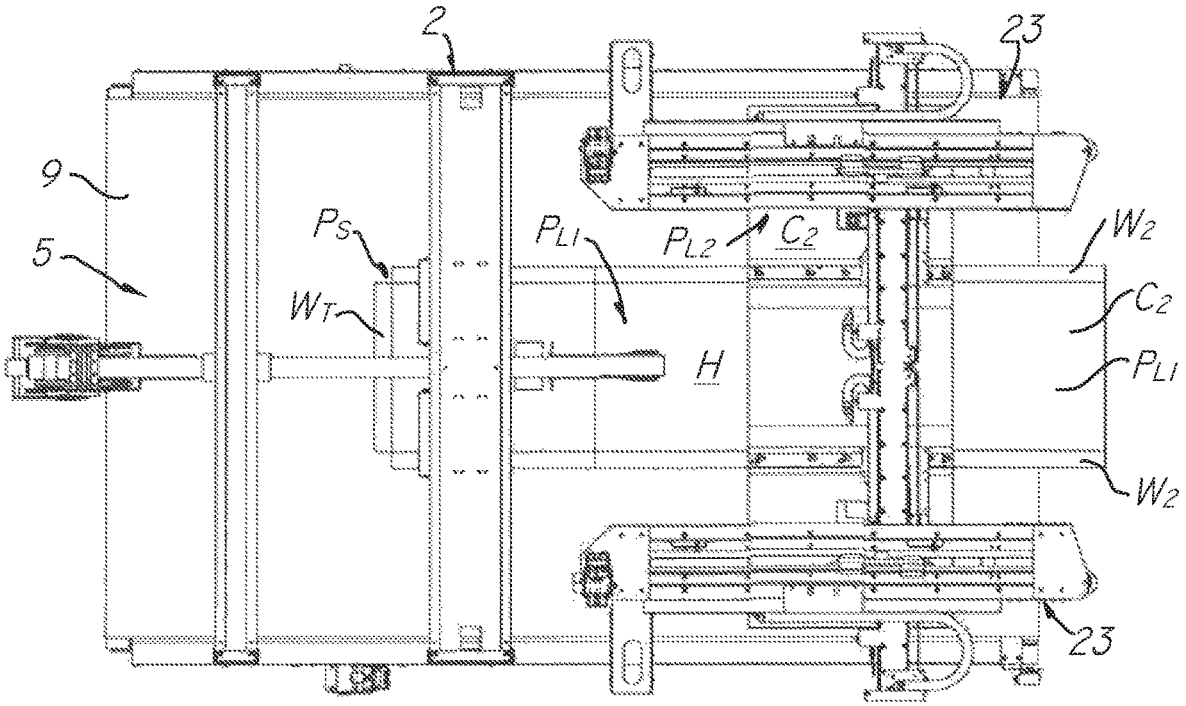
Figure 9:
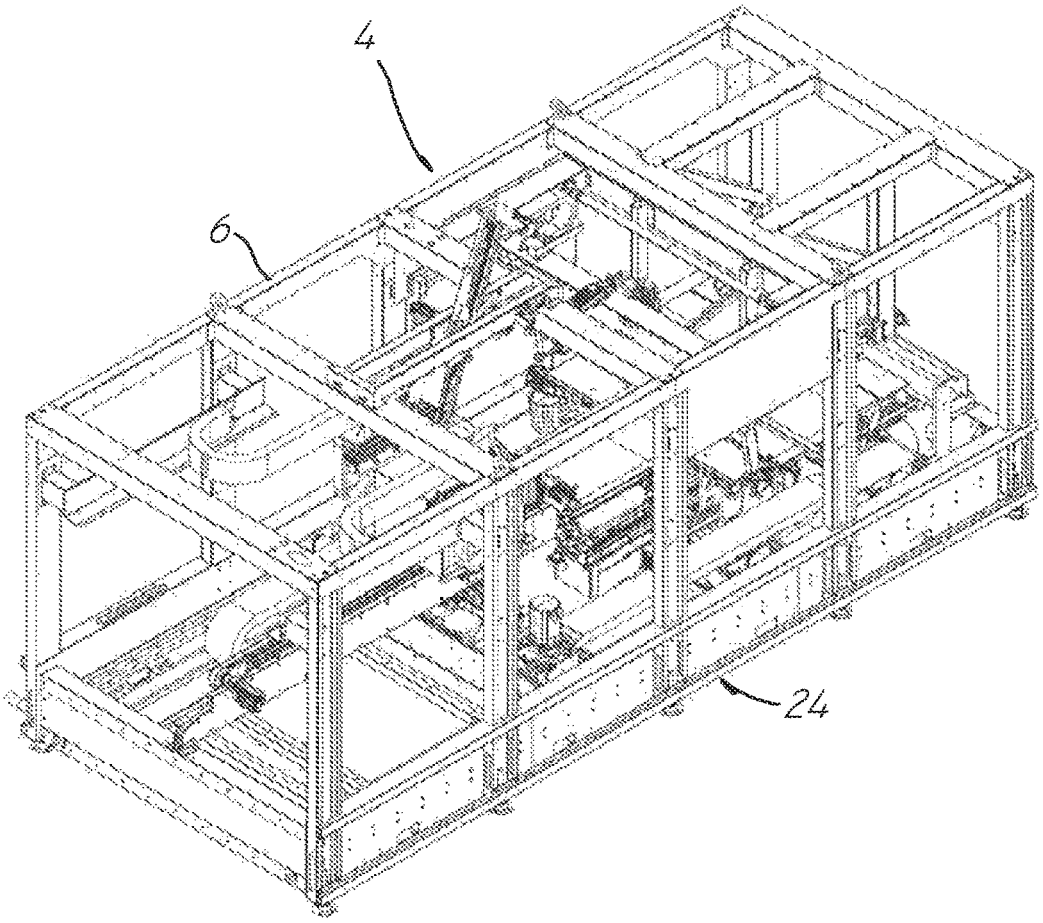
FIGS. 9 and 10 are perspective and broken-away side views of a second station of the plant of the invention.

The first gluing means 21 may comprise a first applicator 22 for applying hotmelt glue strips on the side edges of the elongate element $E_1$, which is placed immediately downstream from the second transverse tools 19, whereas the forming station 2 may comprise a pair of suction-cup manipulators 23, as best shown in FIGS. 7 and 8.

The suction-cup manipulators 23 move along respective transverse directions and are adapted to pick up the transverse panels $E_2$, $E_3$ and to apply them on the elongate element $E_1$ at the glue strips to form the cross-shaped blank H.

Particularly, as best shown in FIG. 14, the transverse panels $E_2$, $E_3$ may be glued to the elongate element $E_1$ at the portion corresponding to the bottom wall $P_F$ with the longitudinal creasing lines in overlapped relationship.

In this configuration, the side flaps $W_2$ of the transverse panels $E_2$, $E_3$ overlap the central body $C_1$ of the bottom wall $P_F$, whereas the side flaps $W_1$ of the bottom wall $P_F$ are glued to the bottom surface $S_{INF}$ of the central body $C_2$ of the respective transverse panel $E_2$, $E_3$.

After forming, the cross-shaped blank H is transferred from the first belt conveyor 9 to the belt system 10 of the closing station 4, while the knife-edge conveyor 12 places the items O on the blank H before it is folded.

In addition, the closing station 4 comprises folding and gluing means 24 for folding and gluing the side walls $P_1$, $P_2$ of the box B and the top closing wall $P_S$ to provide finished packages ready for storage and shipment, once the items O to be packaged have been introduced therein.

Figure 10:
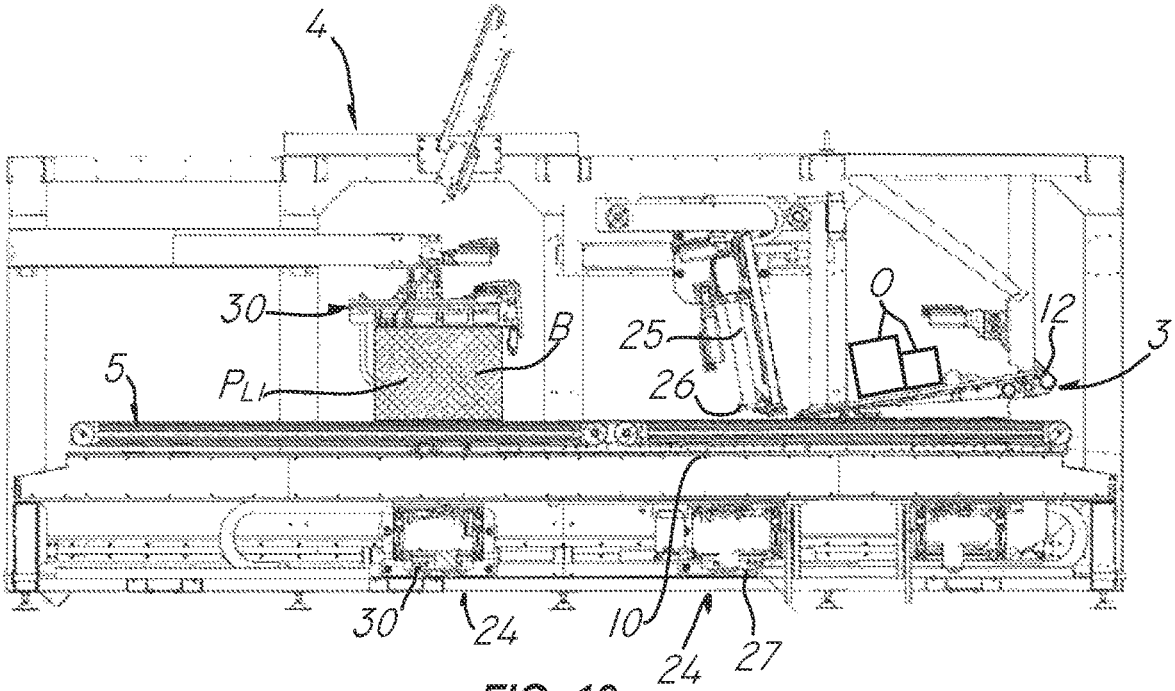

Preferably, the closing station 4 may comprise a robotic arm 25 located immediately downstream from the knife edge conveyor 12, and comprising a second applicator 26 for applying hotmelt glue on the edges of the blank H to be folded, as best shown in FIG. 10.

Particularly, the second applicator 26 will be adapted to distribute the glue strips on the outer surface $S_{OUT2}$ of the side flaps $W_2$ of the first pair of side walls $P_1$ of the cross-shaped blank H.

Furthermore, the robotic arm 25 may move along a vertical axis to guide the items O as they are being positioned on the blank H.

Figure 11:
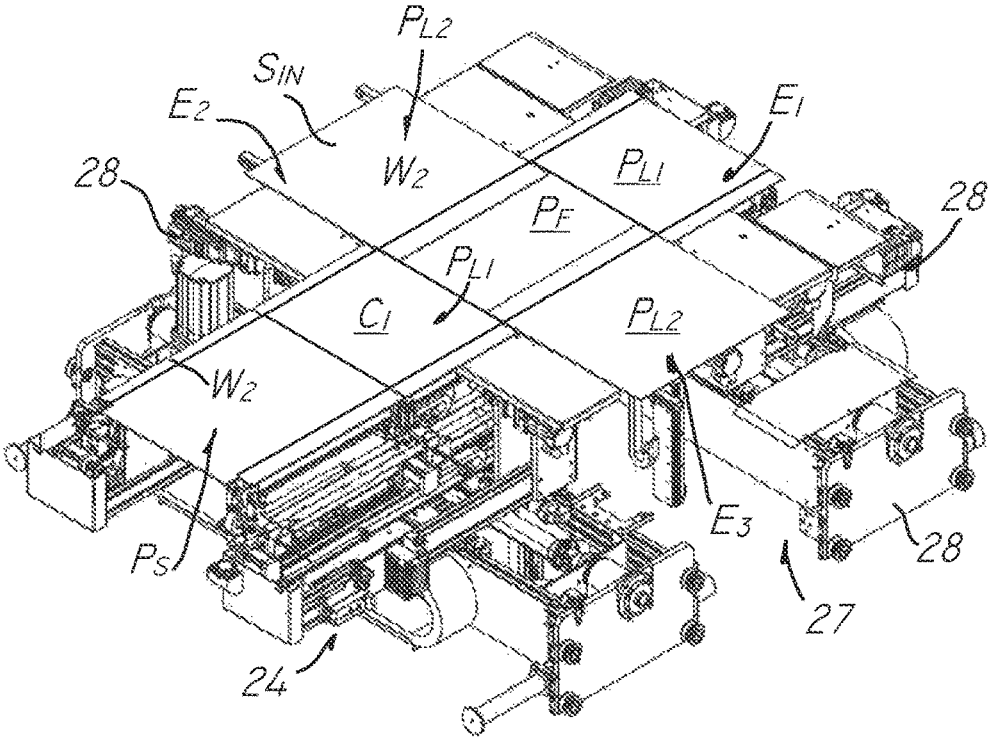
FIGS. 11 and 12 are perspective of a first detail of the second station of FIGS. 9 and 10 in two different operating configurations.
Figure 12:
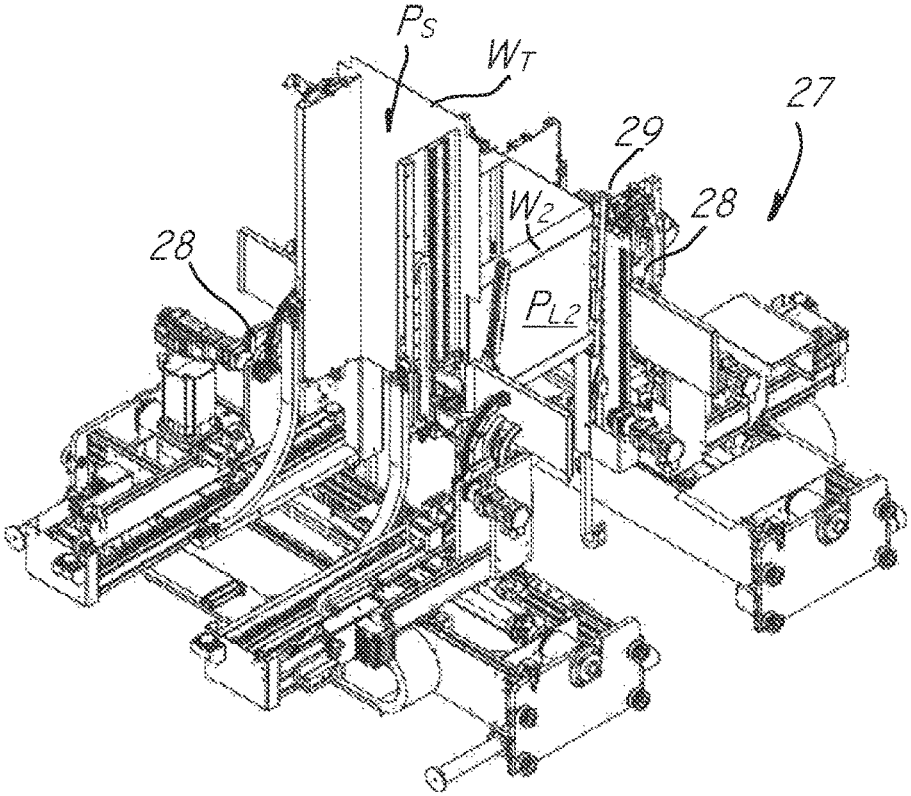
Figure 13:
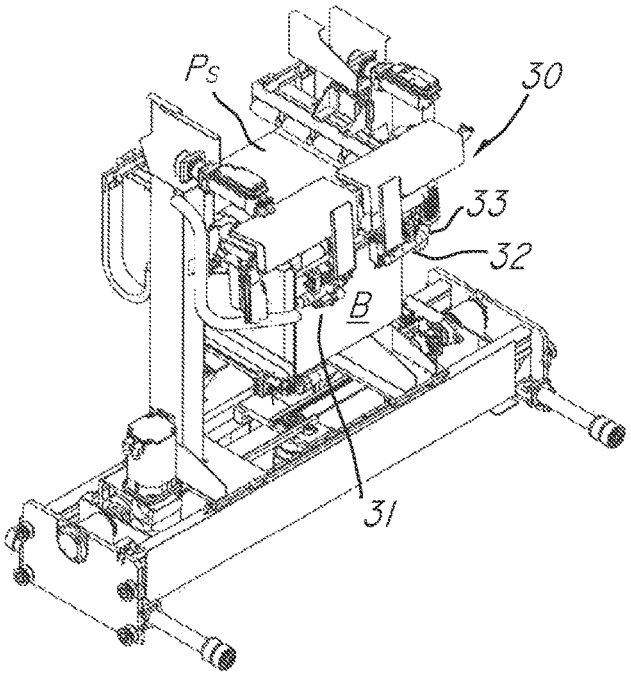
FIG. 13 is a perspective view of a second detail of the second system of FIGS. 9 and 10.

The folding means 24 may comprise a first operating unit 27 with a plurality of tip-up folding actuators 28, as shown in FIGS. 11 and 12, which are coplanar with the feeding belt system 10 in the idle position.

Each of the actuators 28 comprises a respective suction cup member 29 which is adapted to hold the blank H at its side walls $P_1$, $P_2$ and fold it along its respective longitudinal and transverse creasing lines $L_L$, $L_T$.

In this configuration, all the side walls $P_1$, $P_2$ are folded up and the side flaps $W_2$ of the first side walls $P_{L1}$ are glued to the inner surface $S_{IN}$ of the second side walls $P_{L2}$.

Conveniently, the folding means 24 may comprise a second operating unit 30 to fold the top wall $P_S$ of the box B and close the top of the containing compartment.

The second operating unit 30 may comprise a first nozzle 31 for distributing the glue on the transverse flap $W_T$ of the top wall $P_S$ and a second nozzle 32 for distributing the glue on the side flap $W_1$ of the top wall $P_S$.

Furthermore, the second operating unit 30 comprises a plurality of pressing rollers 33 which are adapted to assist gluing of the transverse flap $W_T$ on one of the first side walls $P_{L1}$ and gluing of the longitudinal flaps $W_1$ on the outer surface $S_{OUT3}$ of the second side walls $P_{L2}$.

Thus, each second side wall $P_{1,2}$ is held, both at its top portion and at its bottom portion, by the side flaps $W_1$ of the top and bottom walls $P_S$, $P_F$ and this configuration imparts greater stability to the box 1.

All the moving parts of the plant are motorized and independently managed by the control unit, which is designed to synchronize their relative movements.

Advantageously, such control unit allows forming of the cross-shaped blank H, introduction of the items and folding of the box to occur without ever stopping the feeding means 5.

It will be appreciated from the foregoing that the plant of the invention fulfills the intended objects and particularly affords automatic packaging of a plurality of items in cardboard boxes having a highly resistant structure.

The plant of the invention is susceptible of a number of changes and variants, within the inventive concept as disclosed in the appended claims.

While the plant has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in the field of package producing plants.

The invention claimed is:

1. A plant (1) for automated packaging of items (O) in cardboard boxes (B), wherein each box (B) comprises a bottom wall (PF), a first and a second pair of side walls (PL1, PL2), and a top closing wall (PS), the plant (1) comprising:

a forming station (2) for forming open boxes (B) from a continuous-feed web (M);

introduction means (3) for introducing the items (O) into the open boxes (B);

a closing station (4) for closing the open boxes (B) with the items (O) therein; and feeding means (5) for feeding the open boxes (B) from said forming station (2) to said closing station (4);

wherein said forming station (2) comprises cutting and creasing means (15) for cutting and creasing the continuous-feed web (M), the cutting and creasing means (15) being adapted to provide, a longitudinal elongate element (E1) defining the bottom wall (PF), the top closing wall (PS), and the first pair of side walls (PL1) of the box (B), and a pair of transverse panels (E2, E3) adapted to form the second pair of side walls (PL2) of the box (B), and first gluing means (21) for gluing the transverse panels (E2, E3) to the longitudinal elongate element (E1), in such a manner to provide a substantially cross-shaped, one-piece deployed blank (H), wherein said first gluing means (21) comprise a first applicator (22) for applying hot-melt adhesive strips on side edges of the longitudinal elongate element (E1), wherein said forming station (2) comprises a pair of suction-cup manipulators (23) for picking up the transverse panels (E2, E3) and applying the transverse panels on the elongate element (E1) at the hot-melt adhesive strips to obtain the blank (H), and wherein said closing station (4) comprises folding and automatic gluing means (24) for folding and gluing the side walls (PL1, PL2) of the box (B) and the top wall (PS), such that finished packages are formed, which are ready for storage or shipment.

2. The plant as claimed in claim 1, further comprising supply means (7) for supplying the continuous-feed web (M) into said forming station (2) in a longitudinal direction (X).

3. The plant as claimed in claim 1, wherein said cutting and creasing means (15) comprise a first series of transverse tools (16) mounted to a first carriage (17), moving transverse to a direction of feed (X) of the continuous-feed web (M), and a first series of longitudinal tools (18) adapted to form a plurality of longitudinal cutting and creasing lines (LL) on the blank (H).

4. The plant as claimed in claim 3, wherein said cutting and creasing means (15) comprise a second series of transverse tools (19) mounted to a second carriage (20), moving transverse to the direction of feed (X) of the blank (H) and adapted to form a plurality of transverse creasing lines (LT) thereon.

5. The plant as claimed in claim 1, wherein said feeding means (5) comprise a first, substantially inclined belt conveyor (9) located in said forming station (2) and a belt system (10) located in said closing station (4) for receiving the blank (H) from said first belt conveyor (9).

6. The plant as claimed in claim 5, wherein said introduction means (3) for introducing the items (O) comprise a series of second belt conveyors (11) located in said forming station (2) and above an inclined plane ($\pi$) of said first belt conveyor (9) and a knife edge conveyor (12) located in said closing station (4) for depositing the item (O) to be packaged on the blank (H) before the blank is folded.

7. The plant as claimed in claim 6, wherein the belt (11') of said series of said second belt conveyors precedes said knife edge conveyor (12) and is slidably guided so as to center a position of said knife edge conveyor with respect to the blank (H) that is being fed along said first belt conveyor (9).

8. The plant as claimed in claim 6, wherein said closing station (4) comprises a robotic arm (25) located immediately downstream of said knife edge conveyor (12), and comprising a second applicator (26) for applying the hot-melt adhesive strips on the edges of the box (B) to be folded.

9. The plant as claimed in claim 5, further comprising a belt conveyor (14) for conveying trimmings generated by said cutting and creasing means (15), said belt conveyor (14) being located below said first belt conveyor (9) and being adapted to convey the trimmings toward a shredding unit.

10. The plant as claimed in claim 1, wherein said folding and automatic gluing means (24) comprise a first operating unit (27) comprising a plurality of tilting actuators (28) with respective suction cup members (29) which are adapted to hold the blank (H) at its side walls (P1, PL2) and fold the blank along its respective longitudinal (LL) and transverse (LT) crease lines.

11. The plant as claimed in claim 10, wherein the top wall (PS) of the box (B) comprises a transverse flap (WT) and a pair of longitudinal flaps (W1), and wherein said folding and automatic gluing means (24) comprise a second operating unit (30) comprising a first nozzle (31) for distributing glue on the transverse flap (WT) and a second nozzle (32) for distributing the glue on the longitudinal flaps (W1), said second operating unit (30) also comprising a plurality of pressing rollers (33) for gluing the flaps (WT, W1) on the side walls (P1, PL2) of the box (B).

* * * * *